United States Patent [19]

Johnston

[11] Patent Number: 4,873,755

[45] Date of Patent: Oct. 17, 1989

[54] SWAGING TOOL HAVING INDICATING MEANS

[75] Inventor: Lonnie E. Johnston, Bedford, Ohio

[73] Assignee: Crawford Fitting Company, Solon, Ohio

[21] Appl. No.: 198,775

[22] Filed: May 25, 1988

[51] Int. Cl.[4] ..... B23P 19/06; B23Q 15/14

[52] U.S. Cl. ..... 29/237; 29/282; 29/517; 29/720; 72/318

[58] Field of Search ..... 29/237, 282, 516, 520, 29/517, 235, 720; 72/317, 316, 318

[56] References Cited

U.S. PATENT DOCUMENTS

| | | |
|---|---|---|
| 1,039,096 | 9/1912 | Christenson . |
| 3,156,284 | 11/1964 | Stanley . |
| 3,385,087 | 5/1968 | Huth . |
| 3,568,494 | 3/1971 | Geisman . |
| 3,691,604 | 9/1972 | Spontelli . |
| 3,722,064 | 3/1973 | Spontelli . |
| 3,726,122 | 4/1973 | Dawson . |
| 3,728,771 | 4/1973 | Spontelli . |
| 3,786,677 | 1/1974 | Spontelli . |
| 3,810,296 | 5/1974 | Spontelli . |
| 4,308,736 | 1/1982 | Lowe et al. . |
| 4,331,019 | 5/1982 | Smith . |
| 4,364,258 | 12/1982 | Davidson . |

FOREIGN PATENT DOCUMENTS

| | | | |
|---|---|---|---|
| 2317757 | 10/1974 | Fed. Rep. of Germany | 29/237 |
| 2033811 | 5/1980 | United Kingdom | 29/237 |

*Primary Examiner*—Mark Rosenbaum
*Assistant Examiner*—Peter Dungba Vo
*Attorney, Agent, or Firm*—Fay, Sharpe, Beall, Fagan, Minnich & McKee

[57] ABSTRACT

A device for swaging a ferrule onto the periphery of a cylindrical member includes a piston mounted for reciprocation within a body and an anvil member drivingly connected to the piston and having a recess in one end to receive the end of the cylindrical member. A camming body is associated with the anvil member for camming a ferrule carried on the end of the cylindrical member into tight peripheral engagement therewith. A gauge device is associated with the camming body for measuring the movement of the camming body relative to the body housing the piston. The camming device includes an articulated signal member having a first arm and a second arm one end of which is secured to the end of the first arm. The second arm is selectively pivotable about the first arm and a resilient spring is used to urge the second arm to one end position in relation to the first arm. A biasing member is used for moving the signal member from a first to a second position. The signal member is held in the first position until a predetermined amount of relative movement has taken place between the camming body and the piston housing body. At that time, the signal member is caused to move suddenly to the second position under the action of the biasing member.

25 Claims, 6 Drawing Sheets

SWAGING TOOL HAVING INDICATING MEANS

BACKGROUND OF THE INVENTION

The subject invention is directed toward the coupling art. More specifically, the present invention is directed to an improved apparatus for swaging ferrules to the outer surface of elongated cylindrical members.

The invention is especially suited for use in swaging ferrules of tube fittings and will be described with particular reference thereto. However, it should be appreciated by those skilled in the art that the invention is capable of broader applications and could be used for attaching ferrules to many types of cylindrical members.

Tube or pipe fittings which employ one or more swaged ferrules on the periphery of a tube to make metal to metal seals at a joint are in widespread use. Experience has shown that the swaged ferrule type fittings with their metal to metal sealing surfaces are particularly effective in providing strong leak-tight joints. In swage type tube fittings, the grip of a swaged ferrule on the periphery of the tube is critical to the proper functioning of the fitting. Typically, the nose portion of the ferrule must be forced radially inward to achieve a good grip on the tube but without extensive tube deformation.

With fittings currently in use, the ferrules are typically swaged into sealing position by a manual tightening of a coupling nut which forces the nose portion of the ferrule against a camming mouth in an associated body member. The camming mouth deforms the nose radially inward into tight sealing engagement with the periphery of the tube or rod being coupled.

Power actuated ferrule swaging devices have been proposed in the prior art. Generally, these prior art devices have been somewhat complicated and cumbersome and have required die blocks and the like for engaging the ferrules and cooperating with a die member to perform the swaging operation. Generally, such power actuated swaging devices are used with large sized tubes or tubes formed of very hard material in order to apply the necessary swaging torque since for these applications it is difficult to get the necessary torque by a manual operation.

One problem with manually swaging ferrules on a conduit has been the difficulty of inexperienced operators in judging when adequate swaging has taken place. Another problem with a manual swaging of ferrules has been the length of time it takes to adequately swage a ferrule on a tube or pipe. This tends to be a problem when numerous swaging operations need to take place on a complicated conduit system of the type that is generally used in certain types of vehicles, such as airplanes.

While power actuated ferrule swaging devices might indicate when adequate swaging has taken place and might reduce the length of time the swaging operation takes, they have their own problems. For one, currently available swaging devices do not have an indicator means to let the operator know when a ferrule has been put in backwards or has been omitted entirely. Additionally, the conventional power actuated ferrule swaging devices utilize a coupling nut or female body portion of the fitting into which the swaged tube will be received to assist the swaging operation by threading the nut into engagement with a sleeve held on the tool. This operation is time consuming since the nut needs to be threaded onto the sleeve before the swaging operation and off the sleeve after the swaging operation.

Additionally, with the presently utilized power operated swaging tools which have an indicator arm cooperating with an indicator knob to form a latch mechanism, the knob needs to be readjusted for each swaging operation and this extra step adds to the length of the swaging operation. Also, normally a rubber hose or other flexible hose is connected between a pump mechanism and the swaging tool. Therefore, several additional pumping strokes are needed just to pressurize the fluid in the hose due to the normal expansion that a flexible hose undergoes.

Accordingly, it has been considered desirable to develop a new and improved swaging tool which would overcome the foregoing difficulties and others while providing better and more advantageous overall results.

BRIEF SUMMARY OF THE INVENTION

In accordance with one aspect of the present invention, a new and improved device for swaging a ferrule onto the periphery of a cylindrical member is provided.

More particularly in accordance with this aspect of the invention, the device comprises a piston mounted for reciprocation within a body and an anvil member drivingly connected to the piston and having a recess in one end to receive the end of the cylindrical member. A camming means is associated with the anvil member for camming a ferrule carried on the end of the cylindrical member into tight peripheral engagement therewith. A gauge means is associated with the camming means for measuring the movement of the camming means relative to the body. The gauge means comprises an articulated signal member comprising a first arm and a second arm which is secured at one end to the first arm and is selectively pivotable thereabout. A means for urging the second arm to one end position in relation to the first arm is also provided. A biasing means moves the signal member from a first to a second position. A means is provided for holding the signal member in the first position until a predetermined amount of relative movement has taken place between the camming means and the body at which time the signal member is caused to move suddenly to the second position under the action of the biasing means.

In accordance with another aspect of the invention, a tool is provided which comprises a means for swaging a ferrule onto the periphery of a cylindrical member. A frame means supports and aligns the cylindrical member with the swaging means which is reciprocable with respect to the frame means. An independently actuated signal means is provided for indicating adequate swaging of the ferrule in response to a gauged relative movement between the frame means and the swaging means. The signal means includes an articulated signal member comprising a first arm and a second arm which is secured to one end of the first arm and is selectively pivotable thereabout. A means is provided for urging the second arm to one end position in relation to the first arm. The signal member is biased to swing away from a latching means upon adequate swaging of the ferrule.

In accordance with still another aspect of the invention, an apparatus is provided for swaging a ferrule onto the periphery of a cylindrical ember. The apparatus comprises a piston mounted for reciprocation within a body and an anvil member cooperatively associated for movement with the piston. A cylindrical recess in the anvil member receives the end of a cylindrical member and the recess includes a camming mouth. A means is carried by the body for connection thereto of a means for (a) aligning the cylindrical member with the recess and (b) limiting the axial movement of the ferrule received over the end of the cylindrical member. The means for aligning the cylindrical member and limiting axial movement of the ferrule comprises a retaining cap that is slidably mounted on the body. The pressure means is connected in fluid communication with the interior of the body for driving the piston toward the ferrule. A signal means is provided for indicating adequate swaging of the ferrule in response to a gauged relative movement between the piston and the body.

In accordance with a yet further aspect of the invention, an apparatus is provided for pre-swaging to the outer surface of a cylindrical member the ferrules or fittings of the type including a threaded coupling nut having an internal opening and adapted to encircle the cylindrical member and an associated ferrule positioned on the cylindrical member.

More particularly in accordance with this aspect of the invention, the apparatus comprises a first means for engaging and positioning the end of a cylindrical member on which a fitting is to be connected and a camming means associated with the first means. The camming means is sized to extend inwardly from one end of the member between the outer periphery of the member and the internal opening of the coupling nut. A second means is provided for engaging the coupling nut. The second means comprises a retaining cap which can selectively enclose the coupling nut. A power means is provided for producing non-rotary relative movement toward one another of the camming means and the coupling nut to cause a ferrule positioned therebetween to be swaged on the outer surface of the cylindrical member.

According to another aspect of the invention, a method is provided for swaging a ferrule onto the periphery of a tube or rod.

More particularly in accordance with this aspect of the invention, the method comprises the steps of mounting a nut and a ferrule onto the periphery of a tube or rod and inserting the end of the tube or rod into a swaging tool. The nut is enclosed in the retaining cap mounted on the tool to (a) align the tube or rod with a camming mouth within the tool and (b) limit the axial movement of the ferrule. A force is then applied to cause a relative movement between the ferrule and the camming mouth to swage the ferrule into tight engagement with the periphery of the tube or rod.

One advantage of the present invention is the provision of a new and improved swaging tool.

Another advantage of the present invention is the provision of a swaging tool mounted, together with a pump, on a base in a portable assembly which allows a rapid swaging of ferrules on a tube.

Still another advantage of the present invention is the provision of a swaging tool in which a retaining cap is used to retain the nut and ferrules in place on the tool thus eliminating the necessity of threading the nut on and off the tool thereby speeding up the operation of the swaging unit and permitting the outer diameter of the swaging anvil to be significantly increased which helps eliminate a flaring of the swaging mouth of the anvil due to use thereof.

Yet another advantage of the present invention is the provision of a swaging tool in which the swaging anvil can be replaced without having to disassemble the tool. Such a construction reduces the anvil cost and allows the tool to be easily modified with a new anvil whenever necessary.

A further advantage of the present invention is the provision of a swaging tool with an indicator arm which allows the arm to be set without having to rotate an associated indicator knob in and out in order to set the arm. This speeds up the operation of the swaging tool.

A yet further advantage of the invention is the provision of a swaging assembly in which the swaging tool is connected to a pump by a rigid tube to eliminate the wasted pumping strokes needed due to the expansion of a conventional flexible hose that normally connects the tool to the pump.

A still further advantage of the present invention is the provision of a new and improved holder on which a swaging tool and a pump can be positioned. The holder includes a pivotable handle by which it can be carried.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 2:
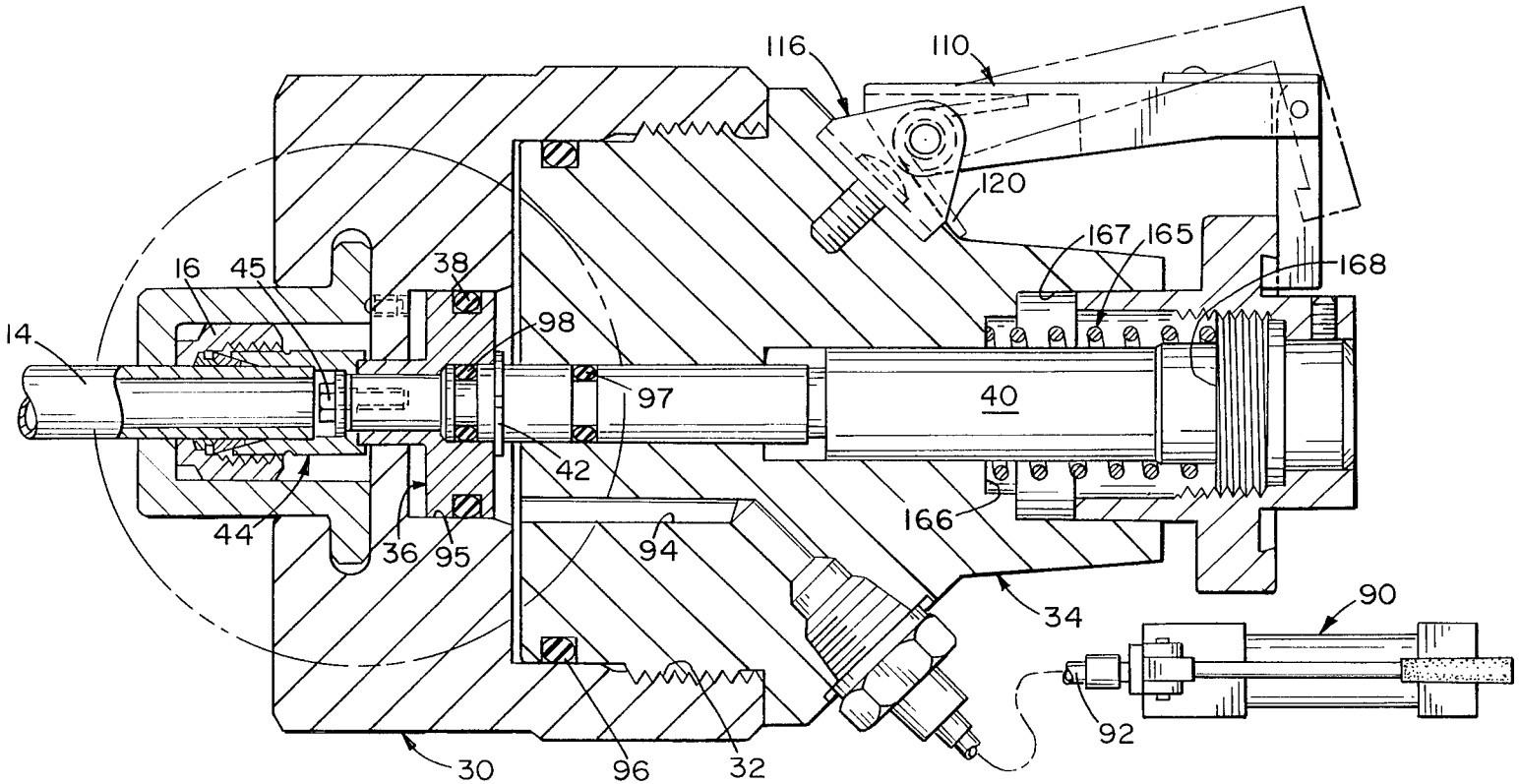
FIG. 2 is an enlarged side elevational view in cross section of the swaging tool of FIG. 1 connected to a fluid pump.
Figure 2A:
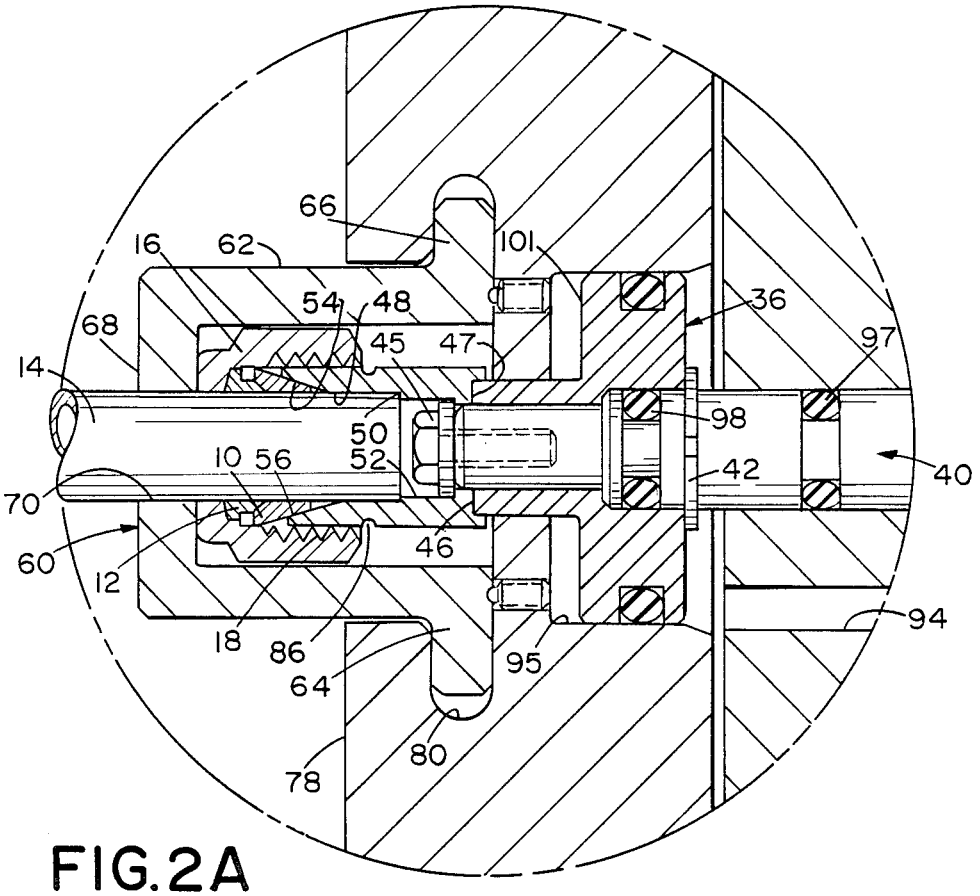
FIG. 2A is an enlarged cross-sectional view of a left end portion of the swaging tool of FIG. 2.
Figure 6:
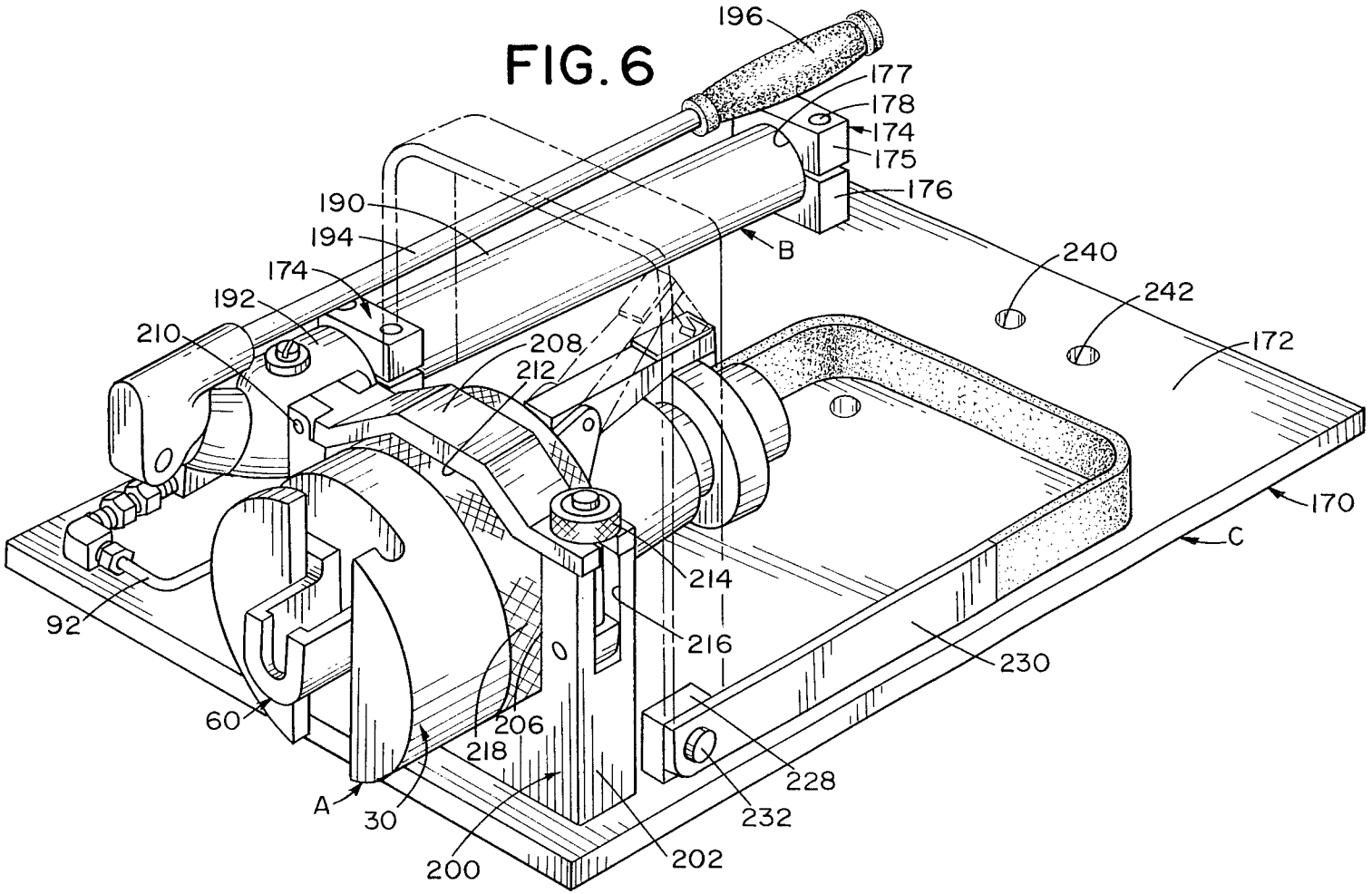
FIG. 6 is a perspective view of the swaging tool and pump of FIG. 2 secured to a base to form a portable assembly; and, FIG. 7 is a top plan view of the assembly of FIG. 6.

Referring now to the drawings wherein the showings are for purposes of illustrating a preferred embodiment of the invention and not for purposes of limiting same, FIG. 6 shows the subject new swaging tool A together with a fluid pump B and mounted on a holder C. While it is to be appreciated that the device could be used for setting or swaging ferrules on many types of elongated cylindrical members, it is shown in FIG. 2A of the drawings as being used to swaqe a pair of ferrules 10, 12 to the outer peripheral surface of a pipe or tube 14. In the particular embodiment shown, the ferrules are of a specific type. It is to be appreciated, however, that the specifics of the ferrules or their use is not critical to the present invention's concept.

With continuing reference to FIG. 2A, a nut 16 is a coupling nut component of the fitting into which the tube 14 is ultimately to be received. The nut 16 has a threaded opening 18 which surrounds both ferrules 10, 12 and is located adjacent an end portion of the tube 14.

Figure 1:
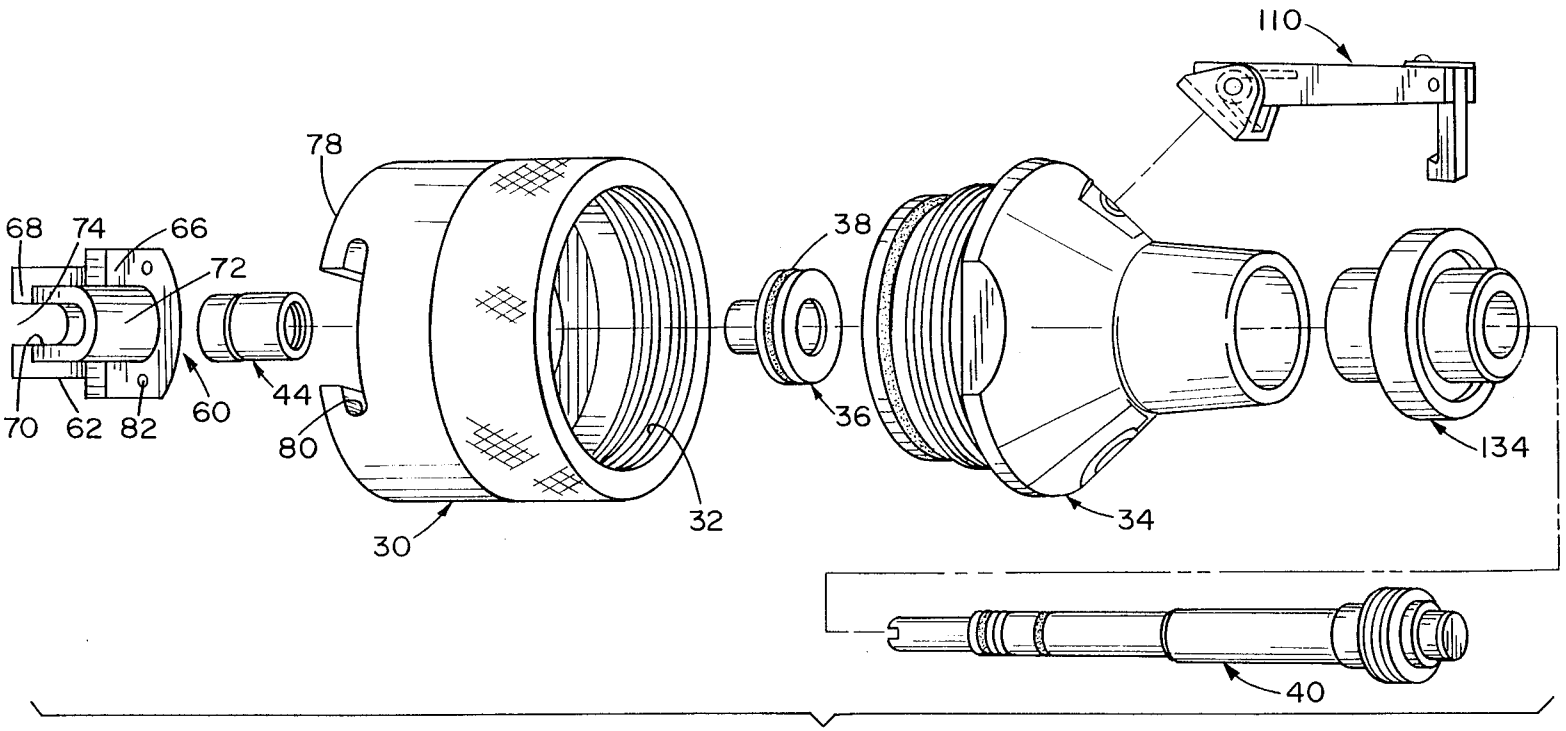
FIG. 1 is an exploded perspective view of the preferred embodiment of the subject new swaging tool.

Although the swaging tool A could have a variety of different constructions, in the embodiment under consideration, as shown in FIG. 1, it includes a cylindrical housing 30 which is threadedly connected at 32 to a body 34. Carried within the cylinder housing 30 and arranged for reciprocation therein is a piston 36. A suitable packing or piston ring means 38 is carried about the periphery of the piston 36 to provide a seal with the internal wall of a chamber in the cylinder 30. The piston is positioned near a left hand end of a shaft 40 and is limited in one direction of motion by a snap ring 42 as shown in FIG. 2. Carried at the left hand of the shaft 40 is an anvil-like swaging or camming member 44 which is drivingly connected to the end of the shaft 40 by a fastener 45.

With reference again to FIG. 2A, it can be seen that a front face 46 of the piston abuts against an indented rear face 47 of the anvil 44 to hold the piston in place. Extending inwardly from the left end of the anvil 44 is a recess 48 which is sized so as to closely receive the end of the tube 14 and align it with the cylinder housing 30. The end of the tube 14 is seated on a shoulder section 50 of the anvil 44 with the shoulder being defined between the recess 48 and a smaller diameter bore 52. The anvil is further provided with a tapered swaging or camming surface 54 which forms a camming mouth that functions to swage or cam a forward nose portion 56 of the ferrule 10 inwardly and into tight sealing gripping engagement with the periphery of the tube 14 in a manner to be described.

In the embodiment shown, the apparatus is used for pre-swaging the ferrule of a standard tube fitting. As shown, the nut 16 is the female body portion of the tube fitting and its internal threaded opening 18 surrounds the tube and the ferrules. In the subject device unlike the prior art swaging tools, the nut, while it is utilized to assist in the swaging operation, is not secured by its threads to the swaging tool.

Instead, a retaining cap 60 is employed to hold the nut 16 in place. With reference also to FIG. 1, the retaining cap comprises an annular body portion 62 having a first end 64 that is provided with an outwardly flaring section 66 and a second end 68 which extends radially and axially inwardly of the annular body portion to form a centrally disposed U-shaped aperture 70 to allow the tube 14 to extend therethrough. The cap in general has a closed bottom section 72 and an open top section 74 to allow the cap to slide in one direction in relation to the tube. The retaining cap outwardly flaring end 66 is so dimensioned as to slide in the cylinder housing 30. For this purpose, cut into an end face 78 of the cylinder is a T-shaped slot 80 in which the flaring end section 66 of the retaining cap 60 can slide.

Figure 3:
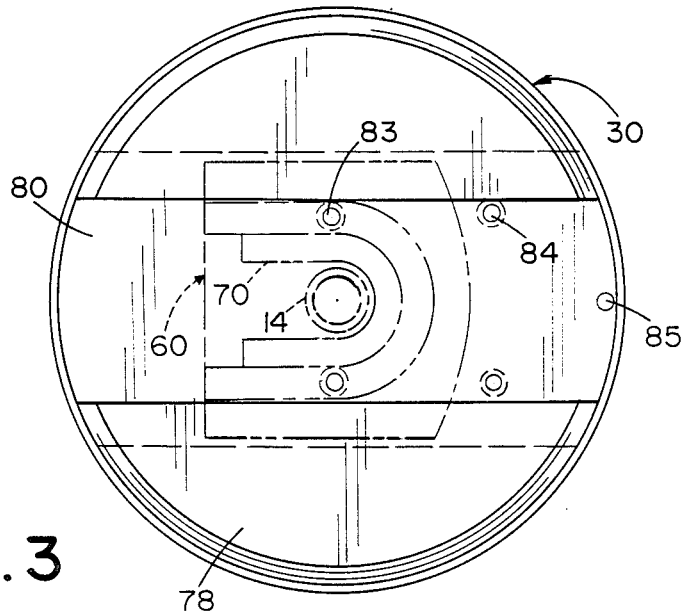
FIG. 3 is an end elevational view of the swaging tool of FIG. 2 from a left end thereof.

With reference now also to FIG. 3, in order to hold the retaining cap in a predetermined position, the cap is provided with a pair of recesses 82 which are adapted to cooperate with first and second pairs of ball detents 83, 84 that are secured in the cylinder housing 30 and positioned in the T-shaped slot 80 thereof. In use, the retaining cap 60 can be moved from an operative position during which it surrounds the tube 14 and the nut 16, and is held in place by detents 83, to an inoperative position during which the cap is prevented from sliding out of the slot 80 by the detents 84. If desired, a pin 85 can be suitably secured to the cylinder 30 at the bottom of the slot 80 to prevent the cap 60 from falling out of the slot. In fact, the detents 84 can be eliminated in favor of the pin 85 if desired.

In the inoperative position of the cap 60, the tube 14, the nut and the ferrules can be positioned in place in the tool A or removed therefrom after the swaging operation has taken place. It is to be appreciated that the provision of the retaining cap allows for a quick removal of the tube 14, the ferrules 10, 12, and the nut 16 without having to unthread the nut as in the prior art swaging tools. This construction also allows the nut threads to remain unused until they are connected to a male portion of a tube fitting (not illustrated).

While the retaining cap 60 is surrounding the tube 14 and the nut 16, a relative movement can be produced between the nut 16 and the anvil 44 for the required swaging of the ferrules 10, 12, into engagement with the outer surface of the tube 14.

With reference again to FIG. 2A, it is also noted that a groove 86 circumscribes the outer periphery of the anvil 44 at a selected location thereon. The groove is advantageous in order to serve as an indicating means to indicate whether both ferrules 10, 12 have been correctly positioned on the tube 14 when the nut 16 is slipped over them and the retaining cap 60 securely holds the nut. If one of the ferrules is omitted, then the nut 16 will slide past the groove 86 to visually indicate that one of the ferrules is missing before the operator conducts the swaging operation. If, on the other hand, one of the ferrules, for example, the ferrule 10 is slipped on the tube 14 backwards, then the nut will not be able to slide up to the groove 86. This will indicate that there is a problem and that the tube 14 should be removed and the ferrules checked. Also, in the latter situation, the retaining cap 60 will likely not be able to slide over the nut into the operative position on the cylinder 30 that is shown in FIG. 2A.

Many different power arrangements could be utilized for producing a required relative movement; however, according to the embodiment under consideration, it is preferable to use hydraulic power. More specifically, and with reference again to FIG. 2, the piston 36 is actuated by a conventional hand operated hydraulic pump 90 through a conduit 92 and a passage 94 which extends through the body 34 to a rear face of a chamber 95 holding the piston. A suitable packing means 96 is located between the body 34 and the cylinder 30 together with a seal 97 which is provided in a grooved section of the shaft 40 to isolate a rear side of the chamber. The plane through the piston is sealed by the packing 38 and a suitable second packing 98, which is provided in a grooved section of the shaft 40 that extends through the piston. In this way, the rear portion of the chamber behind the piston is sealed.

It should be noted that with the construction illustrated in the present invention, the anvil like member 44 and the piston 36 can be readily removed from the shaft 40. More specifically, the anvil like member 44 can be disengaged from the end of the shaft 40 simply by removing the fastener 45. This permits the anvil to be replaced externally without a complete disassembly of the tool A removal of the anvil 44 may be necessary when a modification thereof may be needed to custom fit the anvil for each tool and eliminate a stack up of tolerances to reduce any variation in operation, or when the anvil 44 needs to be replaced, such as when the camming surface 54 thereof has become worn. Also the piston 36 can be removed from the shaft 40 simply by removal of the anvil 44 and of the cylindrical housing 30 from the body 34. The piston and its chamber are so designed that a back face 101 of the piston will bottom out in the tool when adequate swaging has taken place thereby eliminating any possibility of over swaging.

It is noted that in the embodiment illustrated, the anvil 44 has an outer diameter so sized that it just does fit into the nut 16. This relative sizing of the two components is made possible by the provision of retaining cap so that the nut 16 does not have to be threaded onto the swaging tool A. Increasing the thickness of the anvil helps to eliminate a skirt-like expansion of the anvil camming or swaging surface 54 during use thereof thereby increasing its service life.

Figure 4:
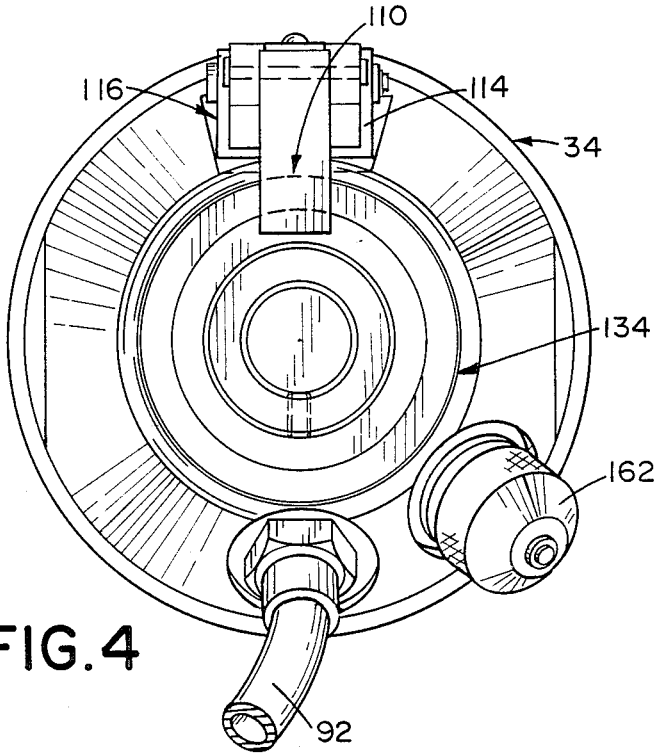
FIG. 4 is an end elevational view of the swaging tool of FIG. 2 from a right end thereof.

Also of importance in speeding up the swaging operation is the inventive signaling or indicating arrangement which provides both a visual and an audible signal when the proper amount of relative movement has taken place between the camming surface 54 and the nut 16. The specific details of the indicating means could take a variety of particular forms; however, in the preferred embodiment, and with reference now to the reverse cross-sectional view of FIG. 5, it includes a signal or lever arm 110 which is mounted for pivotal movement on a pin 112 that extends between the legs 114 of a bifurcated bracket 116 (FIG. 4). The bracket 116 is preferably fixed to the body 34 by a suitable fastener 118. The signal arm 110 is arranged for pivotal movement between the solid and dotted line positions shown in FIG. 2. Preferably, means are provided to maintain the arm under a continual bias. Although the biasing means could take many forms, it preferably comprises a coil spring 120 which extends about the pin 112 and has opposite end portions engaged with the body 34 and the signal arm 110. It will be noted that the signal arm 110 is provided with a longitudinally extending slot 122 in which the spring can be received.

A latching means is provided for holding the signal arm 110 in the solid line position. The latching means is shown as including a groove 132 formed in one face of a knob 134. A flange or outwardly extending portion 136 borders on the outer edge of the groove 132. In the preferred embodiment, the flange has a 5° taper which slopes inwardly toward the groove as is evident from FIG. 5.

The lever arm 110 is provided with a first arm section 140 which is pivotally connected to a second arm section 142 by a pivot pin 144. The free end of the second arm section 142 is provided with a tooth 146 which projects inwardly and is adapted to be received under the flange 136 and in the groove 132 in order to maintain the lever arm 110 in the solid line position. A flat spring 148 is secured on the first arm section by a fastener 149 to bias the second arm section 142 to one end position in relation to the first arm section 140, namely an orientation substantially normal to the first arm.

The knob 134 is secured on the shaft 40 through the use of a threaded section 152 provided on the shaft and a corresponding threaded area 154 provided on a section of an inner bore 155 of the knob. Provided on a rear section of the knob 134 and extending through a bore 156 therein is a set screw 158 Which fastens the knob against a reduced diameter section 160 of the shaft 40. The knob 134 is moved axially on the shaft 40, by means of the cooperating threaded sections 152, 154 at time of assembly of the tool, as needed so that the latching means functions correctly and thereafter secured in place by the set screw 158. In other words, the knob is preferably adjusted at the factory so that the tooth 146 of the lever arm 110 bottoms in the groove 132 of the knob 134. The flange 136 then holds the arm 110 in place against the bias of the spring 120.

With reference now to FIG. 4, the pressurized fluid which enters from the pump B through conduit 92 into the swaging tool bore 94 also communicates through a suitable internal bore (not illustrated) with a relief valve 162 in order to provide for venting of over pressurized fluid. The pressure relief valve is of conventional design and will not be further described herein. If desired, the relief valve 162 can be set to a pressure of approximately 6500 psi. Of course, it should be recognized that any other suitable setting for the pressure relief valve 162 could also be provided.

In operation, the nut 16 is mounted on the tube followed by the ferrules 12, 10. The tube end is then inserted into the cavity 48 of the anvil-like member 44. Thereafter, the retaining cap 60 is slid upwardly from its storage position to its active position so that it surrounds the tube and the nut 16. At this time, fluid can be applied to the front side of the piston 36.

The measured swaging operation can thereafter begin by supplying additional hydraulic fluid to drive the piston 36 and the anvil member 44 toward the ferrules 10, 12 to cause the camming mouth or camming surface 54 of the anvil 44 to engage the nose portion 56 of the front ferrule 10 and swage it radially inward against the tube 14.

It is to be appreciated that the groove 132 is precisely cut to a particular depth which is equal to the needed relative axial movement between the camming surface 54 and the nut 16. This distance is predetermined to provide the desired swaging of the ferrules 10, 12 onto the tube 14. In operation, the piston moves from right to left relative to the signal arm 110, as shown in FIG. 2. This movement, of course, also moves the knob 134 an equal amount. When the piston has moved the desired measured distance to the left (which as mentioned can be equal to the depth of the groove 132) it will release the tooth 146 from the groove and the lever arm 110 can then swing upwardly to the dotted line position as urged by the spring 120. This will produce both a visual and an audible signal indicating that the desired amount of swaging has been performed.

Thereafter, the operator can release the pressure in the cylinder such as by releasing the appropriate valving on the pump 90. Then the retaining cap 60 can be slid downwardly away from the tube 14 in order to allow the tube as well as the nut and the now swaged ferrules to be removed from the swaging tool A.

After the now swaged tube 14 has been removed from the swaging tool, the shaft 40 can be returned to its initial position so that the anvil-like member 44 is ready for another swaging operation. In the embodiment shown, the piston 36 is normally biased to the right (as viewed in FIG. 2) by a spring 165 positioned about the shaft 40. One end of the spring 165 abuts a shoulder 166 formed by counterbore 167. The other end of the spring abuts an inner face 168 of the knob 134. Thus when fluid pressure is relieved behind the piston 36, the spring 165 will bias the shaft 40 to the right in FIG. 2.

Figure 5:
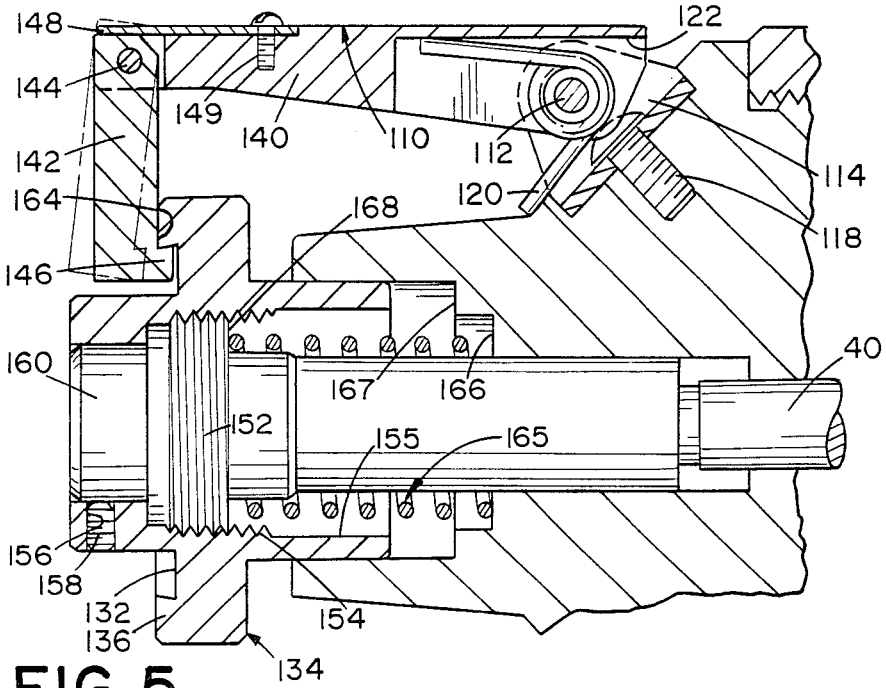
FIG. 5 is an enlarged reverse side elevational view in cross section of a portion of the right end of the swaging tool of FIG. 2.

When this happens, the knob 134 secured on the far end of the shaft 40 will return to its initial position. At this time, it would be desirable to resecure the lever arm to the knob. Unlike the prior art swaging tools in which the knob had to be rotated inwardly towards the tool in order to allow the protuberance on the lever arm to pass freely down past the flange and into the groove, in the present invention, the lever arm 110 is provided with the flat spring 148 which enables the second arm section 142 to pivot outwardly in relation to the first arm section 140 thereby allowing the tooth 146 to clear the flange 136 on the knob 134, as is illustrated in FIG. 5. After the tooth has cleared the flange, the second arm section 142 will be biased inwardly by the spring 148 so that the tooth engages in the groove 132.

As is apparent, the measured distance needed to cause adequate swaging could be gauged by the relative movement between other parts of the assembly. Additionally, the length of the measured travel could be controlled by other than the depth of the groove 132. For example, the groove could be considerably deeper and the tooth 146 of a length equal to the desired swaging distance. In this case, the flange portion 136 would abut a landing 164 on the second arm 142 at the beginning of the swaging cycle. The length of the tooth 146 would then determine the length of the relative movement between the nut 16 and the camming surface 54.

While in use, heretofore, the hydraulic swaging tool elements were anchored to a support by conventional clamps or other means. However, in the present invention, the holder C is provided for this purpose. In use at a factory or plant, the swaging tool A and the pump B are secured on the holder C and the conduit 92 is connected therebetween as shown in FIG. 6 so that the assembly is ready at any time for a swaging operation. The conduit 92 is preferably a metal tube in order to eliminate unnecessary pressurizing strokes which were previously needed with flexible conduits that expanded somewhat during the pressurization of the fluid.

The holder C includes a base 170 which is provided on its upper surface 172 with a pair of spaced anchor clamps 174 for holding the pump B. For this purpose, each clamp includes two mating sections 175, 176 which when secured together define an aperture 177 therethrough for receipt of the pump. Suitable fasteners 178 are provided for securing the anchor clamp sections to each other with the lower section being suitably fastened to the base 170. Securing the other end of the pump B to the base 170 are a pair of flanges 180 (FIG. 7) which are located on the opposing end of the pump. The flanges have suitable apertures 181 therethrough so that fasteners 182 can extend through the flanges and into the base.

The pump has a cylinder 190, and a piston assembly 192 which includes a manually operable actuator rod 194 having at one end a suitable handle 196 which is adapted for movement in a vertical plane relative to the base 170. A shut off valve 197 controlling the flow of pressurized fluid from the pump to the conduit 92 is provided with a handle 198 (FIG. 7) which closes the valve on the upstroke. This is advantageous to prohibit an overtensioning of the valve and possible damage to the valve seat since there is less tendency to jam the valve seat with an upward pull than a downward push. As mentioned, the metallic conduit 92 is secured to the first end of the pump B and communicates pressurized fluid from the pump to the swaging tool A.

A clamp assembly 200 is utilized for securing the swaging tool in place on the base 170. The clamp assembly includes a saddle 202, secured to the base by a suitable conventional means, which includes in its top surface an upwardly opening recess 206. The clamp assembly also includes a cap 208 which overlies the saddle and is pivotally secured thereto at 210 and includes a downwardly opening recess 212. The present clamp assembly also includes a means for adjustably connecting the cap to the saddle. The means comprises a fastener means 214 which can extend through a suitable slot in the cap 208 and is pivotally secured in a slot 216 in the saddle 202. On tightening the fastener means 214, the cap 208 is drawn toward the saddle 202 so that it engages a knurled surface 218 of the swaging tool A to provide a means for holding the swaging tool body periphery in a non-rotating manner.

While in the illustrative embodiment of the invention, one form of anchor clamp is shown, it is contemplated that other suitable types of anchor clamps could be employed which accomplish the function of effectively retaining and anchoring the swaging tool A upon the base C.

The base 170 is also provided with a pair of spaced upwardly extending flanges 228 to which are secured the ends of a handle 230 by a suitable pivoting means 232. The handle can thus be pivoted from a horizontal position where it is adjacent the base 170 to a vertical position where it is substantially normal to the base (as shown in dotted outline in FIG. 6). In the vertical position, the handle 230 allows a person to lift the base 170, and hence the swaging tool A and the pump B secured thereon and transport the entire assembly to a desired location.

Figure 7:
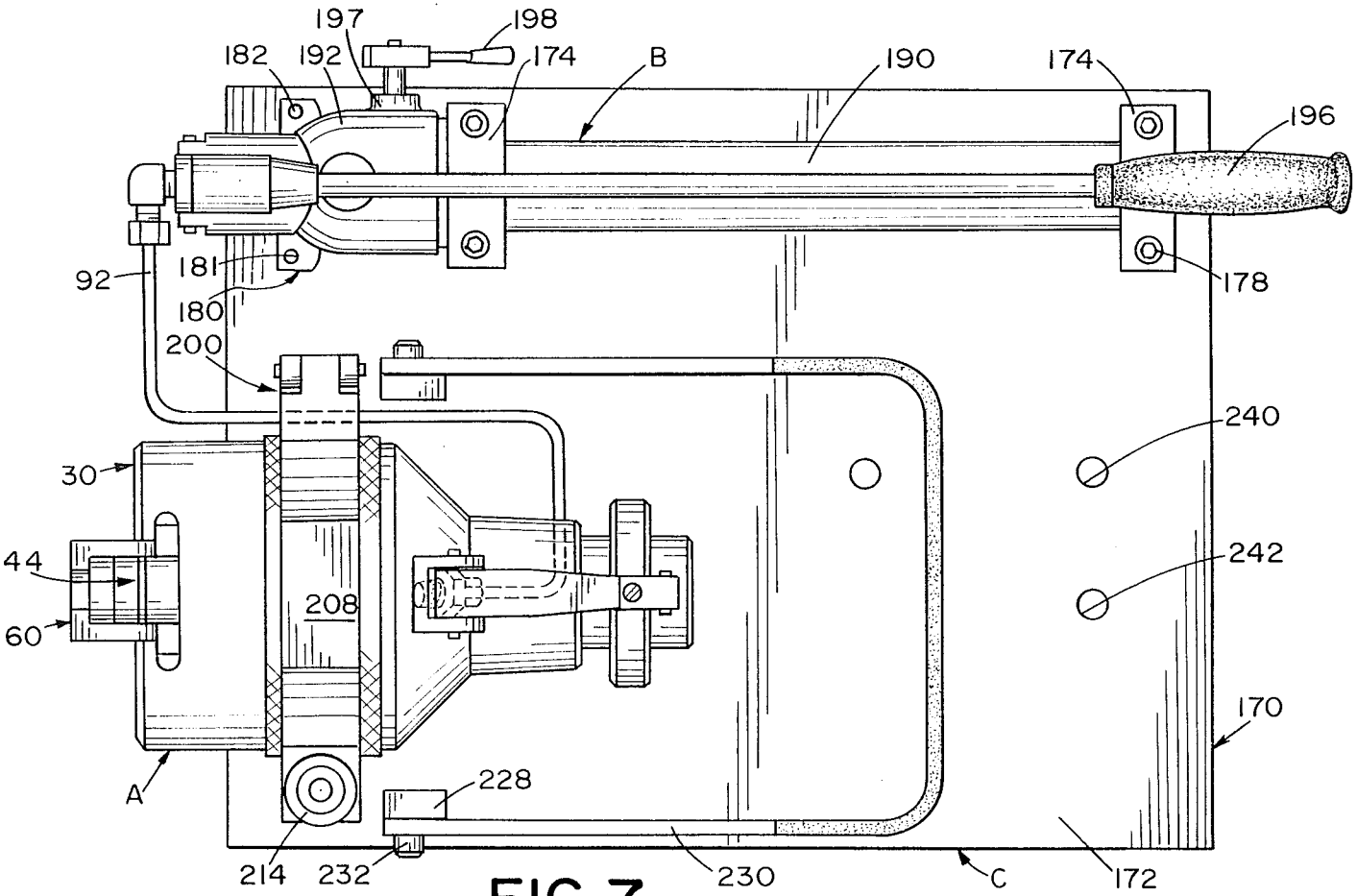

If desired, one or more transverse holes 240 can extend through the base 170 to allow the holder C to be secured by suitable fasteners (not illustrated) to a suitable support surface such as a work bench or the like. Two such holes are illustrated in FIGS. 6 and 7. Also one or more threaded holes 242 can be provided in the base 170 simply to store associated threaded items, such as closure plugs (not illustrated) for the swaging tool A.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

What is claimed is:

1. A device for swaging a ferrule onto the periphery of a cylindrical member comprising:

a piston mounted for reciprocation within a body;

an anvil member drivingly connected to said piston and having a recess in one end to receive the end of the cylindrical member;

camming means associated with said anvil member for camming a ferrule carried on the end of the cylindrical member into tight peripheral engagement therewith; and, gauge means associated with said camming means for measuring the movement of the camming means relative to the body, said gauge means comprising:

an articulated signal member, comprising:

a first arm, a second arm which is secured to one end of said first arm and is selectively pivotable thereabout, a means for urging said second arm to one end position in relation to said first arm, said means for urging being secured to at least one of said first arm and said second arm and being in operative connection with the other of said first arm and said second arm, a biasing means for moving said signal member from a first to a second position, and a means for holding said signal member in said first position until a predetermined amount of relative movement has taken place between said camming means and said body at which time said signal member is caused to move suddenly to said second position under the action of said biasing means.

2. The device of claim 1 further comprising a shaft to which said piston and anvil members are secured and wherein said gauge means further comprises a knob, wherein one of said knob or signal member is mounted on said shaft and the other is mounted on said body.

3. The device of claim 2 wherein said knob is fixedly secured to said shaft and said signal member is mounted on said body.

4. The device of claim 2 wherein said means for holding comprises a latch means between said second arm and said knob for releasing said signal member to move away from said knob upon a movement of said piston through a measured distance.

5. The device of claim 4 wherein said latch means comprises an annular groove in one face of said knob and a protuberance on said second arm for projecting into said groove to hold said signal member stationary against the bias of said biasing means, wherein a radially outer wall of said groove has an approximately 5° undercut and said protuberance has a mating configuration.

6. The device of claim 1 further comprising a shaft and wherein said body comprises:

a cylinder housing having a longitudinally extending bore therethrough and a threaded section;

a body member having a longitudinally extending bore therethrough and a threaded section for threadedly connecting said body member to said cylinder housing threaded section in a coaxial manner so that said shaft can extend through said cylinder housing and body member bores.

7. The device of claim 6 further comprising a retaining cap having a flanged outer lip and wherein said cylinder housing includes a T-slot in which said retaining cap is slidably mounted.

8. The device of claim 7 further comprising a first locking means for securing said cap in a position coaxial with said cylinder housing bore and said body member bore.

9. The device of claim 8 further comprising a retaining means for securing said cap in a position spaced away from being coaxial with said cylinder housing bore and said body member bore.

10. The device of claim 1 wherein said anvil further comprises an indicating means for signaling when the ferrule is missing and is incorrectly positioned on the cylindrical member.

11. Apparatus for swaging a ferrule onto the periphery of a cylindrical member comprising:

a piston mounted for reciprocation within a body;

an anvil member cooperatively associated for movement with said piston;

a cylindrical recess in said anvil member for receiving the end of a cylindrical member and said anvil member including a camming mouth;

a means carried by said body for connection thereto of a means for (a) aligning the cylindrical member with said recess and (b) limiting an axial movement of a ferrule received over the end of the cylindrical member and a coupling nut received over the ferrule wherein said means for aligning said cylindrical member and limiting axial movement of the ferrule and the coupling nut comprises a retaining cap slidably disposed in a T-shaped slot which is mounted on said body;

a pressure means connected in fluid communication with the interior of said body for driving said piston toward the ferrule; and, a signal means for indicating adequate swaging of said ferrule in response to a gauged relative movement between said piston and said body.

12. The apparatus of claim 11 wherein said pressure means comprises a fluid pump which is connected to said body, said body including a fluid passage in said body communicating said fluid pump with a piston chamber located in said body.

13. The apparatus of claim 11 wherein said body comprises a cylinder housing coaxially connected to a body member.

14. The apparatus of claim 13 wherein said cylinder housing includes on one end an outwardly extending flange which is threaded on an inner surface and said body member is threadedly connected to said cylinder housing and wherein another end of said cylinder housing includes a T-slot in which said retaining cap is adapted to slide.

15. The apparatus of claim 14 further comprising a retaining means for holding said retaining cap in a desired position in relation to said cylinder housing.

16. The apparatus of claim 11 wherein said retaining cap comprises:

an annular body portion having first and second ends;

an outwardly flaring end section provided on the first end of said annular body portion; and, an end wall on said second end of said annular body portion, said end wall extending radially and axially inwardly of said annular body portion to a centrally disposed aperture opening to the interior of said annular body portion.

17. The apparatus of claim 16 wherein said aperture in said end wall of said annular body portion second end is in general alignment with the cylindrical member.

18. The apparatus of claim 16 wherein said retaining cap annular body portion has a cavity therein which is suitably sized so as to receive a nut received over the end of the cylindrical member

19. The apparatus of claim 18 wherein said anvil member is substantially cylindrical in shape and has an outer diameter just smaller than an inner diameter of the nut so that said anvil can extend within the nut.

20. Apparatus for pre-swaging to the outer surface of a cylindrical member the ferrules of fittings of the type including a threaded coupling nut having an internal opening and adapted to encircle the cylindrical member and an associated ferrule positioned on the cylindrical member, said apparatus comprising:

a first means for engaging and positioning the end of a cylindrical member on which the fitting is connected;

a camming means associated with said first means and sized to extend inwardly from the end of said member between the outer periphery of the member and the internal opening of the coupling nut;

a second means for engaging said coupling nut, said second means comprising a retaining cap that is slidably disposed in a T-shaped slot and the cap selectively encloses said coupling nut; and, a power means for producing non-rotary relative movement toward one another of said camming means and the coupling nut to cause a ferrule positioned therebetween to be swaged on the outer surface of said cylindrical member.

21. The apparatus as defined in claim 20 wherein said first means comprises a recess sized to receive said cylindrical member and wherein said camming means is positioned about said recess.

22. The apparatus as defined in claim 20 including a means for indicating when sufficient relative movement has taken place between said camming means and the coupling nut.

23. The apparatus of claim 20 wherein said retaining cap comprises:

an annular body portion having first and second ends;

an outwardly flaring end section provided on the first end of said annular body portion; and, an end wall located on said second end of said annular body portion, said end wall extending radially and axially inwardly of said annular body portion to a centrally disposed aperture opening to the interior of said annular body portion.

24. The apparatus of claim 20 wherein said retaining cap has a flanged outer lip and wherein said second means further comprises a cylinder housing which holds said first means and communicates with said power means, said cylinder housing including a T-slot in which said retaining cap is slidably mounted.

25. The apparatus of claim 24 further comprising a locking means for securing said retaining cap in a preselected position in said cylinder housing T-slot.

* * * * *